US008350192B2

(12) United States Patent
Phillips et al.

(10) Patent No.: US 8,350,192 B2
(45) Date of Patent: Jan. 8, 2013

(54) DUAL FAN CONVECTION PERFORMANCE DIVIDER

(75) Inventors: Bryan Thomas Phillips, Hendersonville, TN (US); Cédric Damien Catalogne, Udine (IT)

(73) Assignee: Electrolux Home Products, Inc., Cleveland, OH (US)

( * ) Notice: Subject to any disclaimer, the term of this patent is extended or adjusted under 35 U.S.C. 154(b) by 849 days.

(21) Appl. No.: 12/175,930

(22) Filed: Jul. 18, 2008

(65) Prior Publication Data

US 2010/0012644 A1 Jan. 21, 2010

(51) Int. Cl.
*F27D 7/04* (2006.01)
*A21B 1/26* (2006.01)

(52) U.S. Cl. ..... 219/400; 126/21 A; 99/475

(58) Field of Classification Search ..... None
See application file for complete search history.

(56) References Cited

U.S. PATENT DOCUMENTS

| | | | | |
|---|---|---|---|---|
| 4,029,463 | A * | 6/1977 | Johansson et al. | 432/25 |
| 4,430,541 | A | 2/1984 | Day, Jr. | |
| 4,467,777 | A | 8/1984 | Weber | |
| 4,471,750 | A * | 9/1984 | Burtea | 126/21 A |
| 5,717,192 | A | 2/1998 | Dobie et al. | |
| 6,545,251 | B2 | 4/2003 | Allera et al. | |
| 6,766,796 | B2 | 7/2004 | Franzolin et al. | |
| 6,943,321 | B2 | 9/2005 | Carbone et al. | |
| 7,012,219 | B2 | 3/2006 | Kim | |
| 7,285,756 | B2 | 10/2007 | Leppich et al. | |
| 7,468,495 | B2 * | 12/2008 | Carbone et al. | 219/400 |
| 2004/0040950 | A1 * | 3/2004 | Carbone et al. | 219/400 |
| 2004/0211765 | A1 | 10/2004 | McFadden | |
| 2006/0006163 | A1 | 1/2006 | Carbone et al. | |
| 2006/0011607 | A1 | 1/2006 | Cho et al. | |
| 2006/0027559 | A1 | 2/2006 | Kim et al. | |
| 2006/0130824 | A1 * | 6/2006 | Rummel et al. | 126/21 A |
| 2010/0006085 | A1 * | 1/2010 | Thomas et al. | 126/21 A |
| 2010/0198410 | A1 * | 8/2010 | Choi et al. | 700/275 |
| 2010/0282731 | A1 * | 11/2010 | Jeong et al. | 219/400 |

FOREIGN PATENT DOCUMENTS

| | | |
|---|---|---|
| EP | 1780471 | 5/2007 |
| JP | 57155039 | 7/1982 |
| JP | 11325478 | 11/1999 |

OTHER PUBLICATIONS

International Search Report for PCT/US2009/050668, dated Jan. 22, 2010, 2 pages.

* cited by examiner

*Primary Examiner* — Joseph M Pelham
(74) *Attorney, Agent, or Firm* — Pearne & Gordon LLP

(57) ABSTRACT

An oven includes an interior cavity and a convection heating system for developing a flow of heated air within the interior cavity. The convection heating system includes a plurality of fans to provide a plurality of airflows, and a single convection heating element for heating the plurality of airflows. A shroud is arranged in covering relationship over the convection heating system and includes at least one intake aperture, and a plurality of exhaust apertures for discharging air from the plurality of fans back into the interior cavity. A baffle is located within the shroud and generally between adjacent ones of the plurality of fans. The baffle inhibits mixture of the airflows of each of the fans within the shroud. In one example, a first fan provides a first airflow, a second fan providing a second airflow, and the baffle inhibits mixture of the first and second airflows within shroud.

24 Claims, 7 Drawing Sheets

DUAL FAN CONVECTION PERFORMANCE DIVIDER

RELATED APPLICATIONS

Not Applicable.

FIELD OF THE INVENTION

The present invention relates generally to an oven having a convection heating system, and more particularly, to an oven having a convection heating system with a plurality of fans to control airflow within the oven.

BACKGROUND OF THE INVENTION

Appliances, such as ovens, often have one or more racks generally within the appliance for the placing of cookware, food, and other items within the oven. Additionally, one or more heating elements are provided for heating and cooking the food or other items located within the oven.

In a conventional oven, the oven cavity temperature is controlled by a temperature regulator that turns the heating element on or off as necessary. In addition or alternatively, some ovens further include a convection heating system that typically includes either a gas-fired combustion chamber separate from the oven cavity, or a resistive heating element energized by an electric current, but may also include other types of heating elements such as, for example, an infrared energy source.

A convection oven heats an object in an oven cavity by transferring heat energy from heating elements to the object by circulation of a gas within the oven cavity. Typically, a thermal sensor senses the temperature of the gas and a regulator controls the operation of the heating elements in response to the sensed temperature to maintain a desired operating temperature in the oven cavity. Although the circulated gas in a convection oven for cooking food is typically air, other gases may be employed such as nitrogen, steam, or combustion gases from gas-fired burners, depending upon the oven application. Thus, although convection ovens are commonly used for cooking and baking food, convection oven applications are not limited to cooking and baking. Convection ovens may also be employed in industrial or commercial applications that do not directly cook food.

It is generally known that using a blower, such as a fan, to promote air circulation can dramatically improve the uniformity of air temperature distribution within the oven cavity of a convection oven. However, unmanaged air flow can still be uneven, leading to undesirable cooking or drying of foods.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, an oven is provided that includes a main body portion including an interior cavity, and a convection heating system for developing a flow of heated air within the interior cavity. The convection heating system includes a plurality of fans each rotating in the same direction to provide a plurality of airflows, and a single convection heating element for heating the plurality of airflows. A shroud is arranged in covering relationship over the convection heating system and includes at least one intake aperture for supplying air from the interior cavity to the plurality of fans, and a plurality of exhaust apertures for discharging air from the plurality of fans back into the interior cavity. A baffle is located within the shroud and generally between adjacent ones of the plurality of fans. The baffle inhibits mixture of the airflows of each of the fans within the shroud.

In accordance with another aspect of the present invention, an oven includes a main body portion including an interior oven cavity, and a convection heating system for developing a flow of heated air within the interior oven cavity. The convection heating system includes a first fan providing a first airflow, a second fan providing a second airflow and rotating in the same direction as the first fan, and a convection heating element for heating both of the first and second airflows. A bracket is coupled to the inner wall for securing the single heating element to the inner wall. A shroud is arranged in covering relationship over the convection heating system and the bracket. The shroud further includes at least one intake aperture for supplying air from the interior oven cavity to the first and second fans and a plurality of exhaust apertures for discharging the first and second airflows back into the interior oven cavity. A baffle is located within the shroud and generally between the first and second fans. The baffle is coupled to a portion of the bracket for maintaining the location of the baffle during operation of the convection heating system. The baffle inhibits mixture of the first and second airflows within shroud.

In accordance with yet another aspect of the present invention, an oven includes a main body portion including an interior oven cavity, and a convection heating system for developing a flow of heated air within the interior oven cavity. The convection heating system includes a first rotatable fan providing a first airflow, a second rotatable fan providing a second airflow and rotating in the same direction as the first rotatable fan, and a single convection heating element for heating both of the first and second airflows. Each of the fans and the convection heating element are coupled to an inner wall of the interior oven cavity and extend a distance into the interior oven cavity. A shroud is arranged in covering relationship over the convection heating system including a face surface, an outer peripheral edge, and a pair of legs coupled to the inner wall to offset the face surface a distance from the inner wall to define an interior shroud volume therebetween. The interior shroud volume has a sufficient size to contain the convection heating system. The shroud further includes a pair of intake apertures extending through the face surface for supplying air from the interior oven cavity to each of the first and second fans and a pair of exhaust apertures for discharging the first and second airflows back into the interior oven cavity. Each exhaust aperture is located adjacent a respective one of the fans and is defined between the outer peripheral edge and the inner wall of the interior oven cavity. A baffle is located within the interior shroud volume and generally between the first and second fans. The baffle extends generally between the inner wall and the shroud to divide the interior shroud volume into at least a first sub-volume adjacent the first fan and a second sub-volume adjacent the second fan. The baffle inhibits fluid communication between the first and second sub-volumes.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
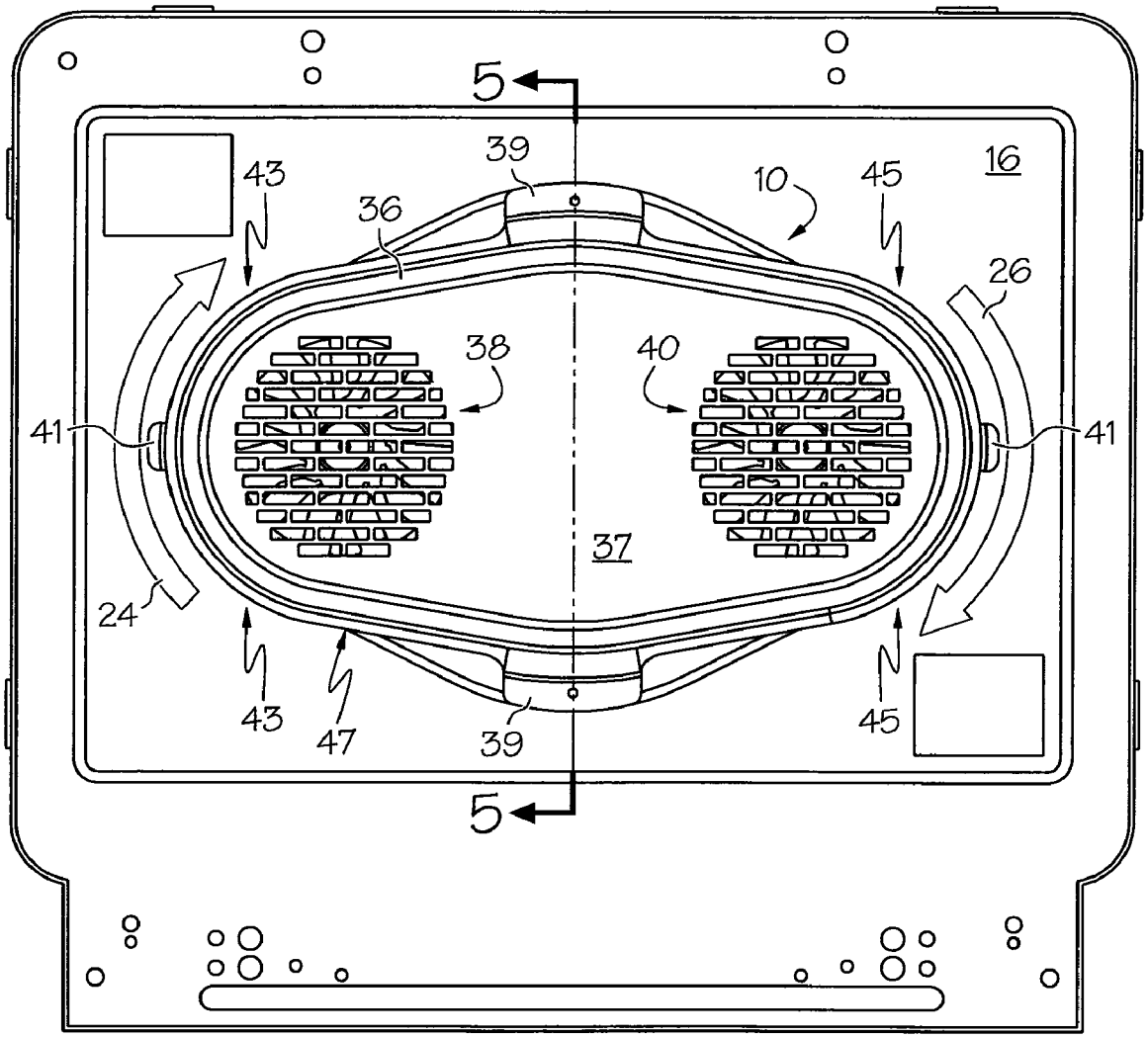
FIG. 1 is front view of an example convection heating system coupled to an inner wall of an example oven in accordance with an aspect of the present invention.

An example embodiment of a device that incorporates aspects of the present invention is shown in the drawings. It is to be appreciated that the shown example is not intended to be a limitation on the present invention. For example, one or more aspects of the present invention can be utilized in other embodiments and even other types of devices.

Figure 7:
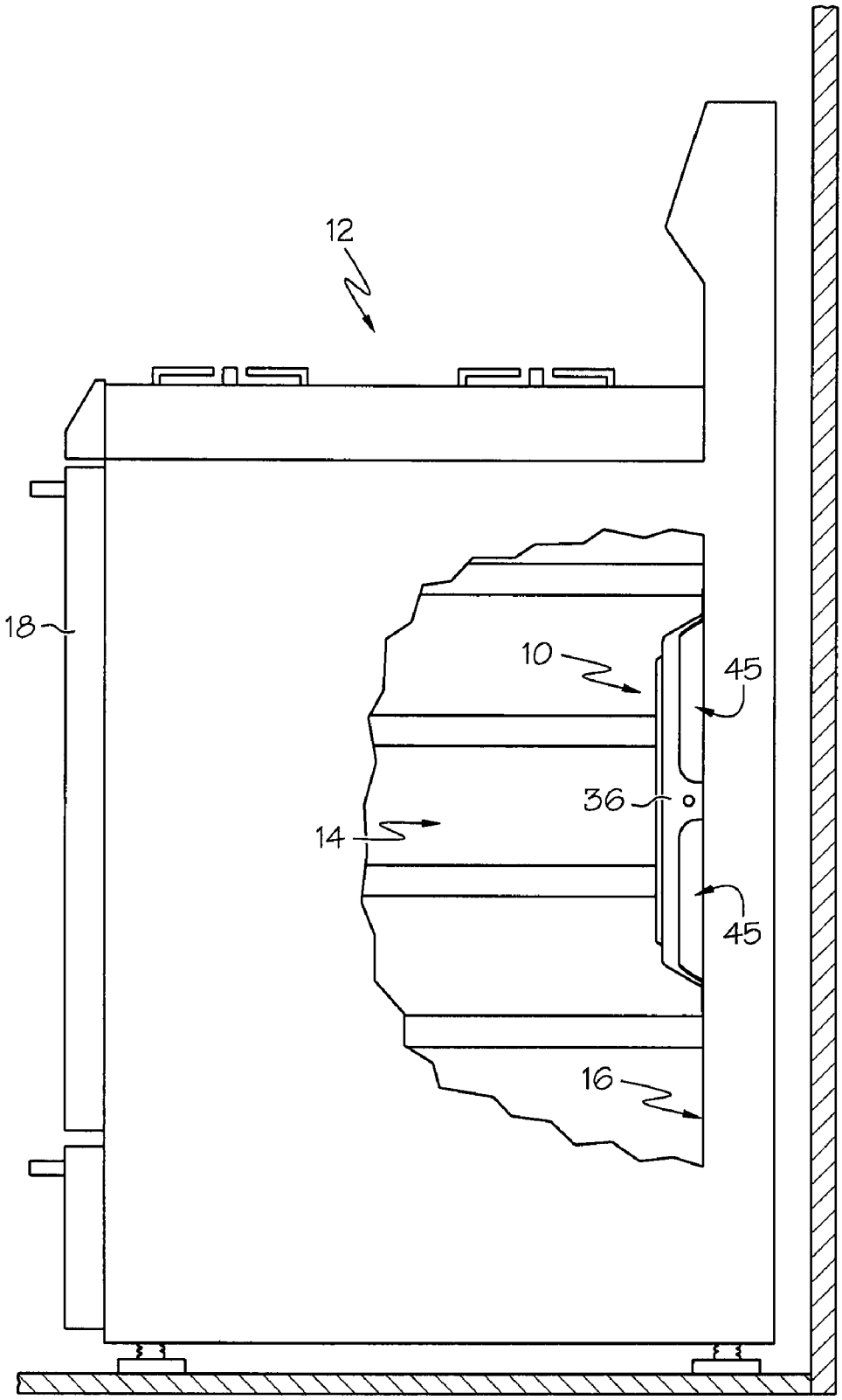
FIG. 7 shows a side view of the example convection heating system of FIG. 1 located within an example oven.

Turning initially to FIGS. 1 and 7, an example convection heating system 10 is shown for use in an example oven 12 (see FIG. 7). The convection heating system 10 can be used in various ovens having various heating elements (e.g., electric, gas, infrared, microwave, etc.) for heating and cooking food or other items located within the oven 12. As shown, the oven 12 generally has an interior cavity 14 for receiving the food or other items to be cooked. The interior cavity 14 is bounded by a plurality of inner walls, such as a top wall, bottom wall, side walls, and a rear wall 16, and is selectively closed by a door 18 that can also form an inner wall. As shown and described herein, the convection heating system 10 is coupled to the real wall 16, though it is to be appreciated that the convection heating system 10 can be coupled to any inner wall of the interior cavity 14, including to more than one inner wall. Moreover, for clarity, only the rear wall 16 is illustrated in FIGS. 1-3 and 5.

Figure 2:
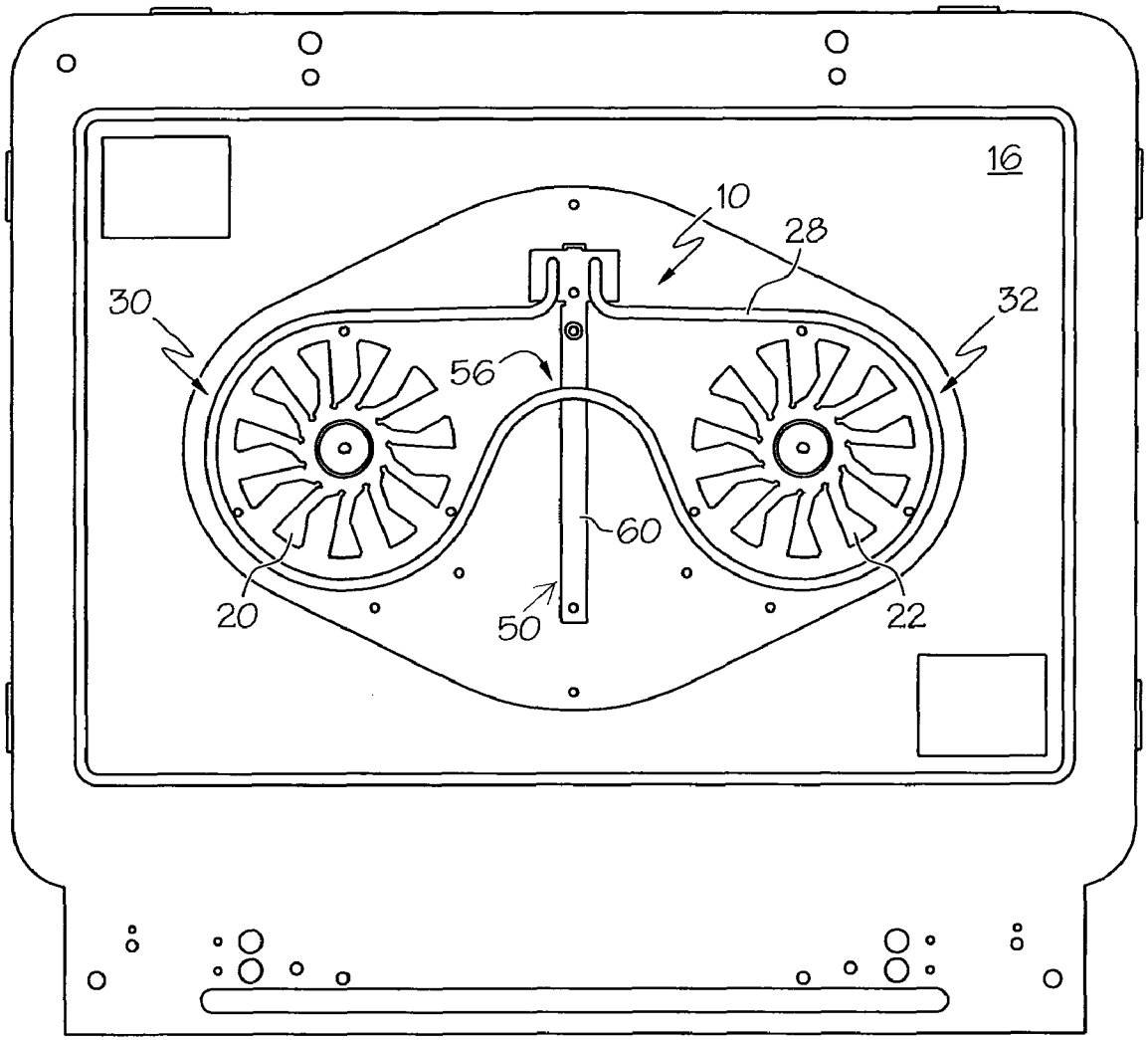
FIG. 2 is similar to FIG. 1, but shows an example shroud removed from the convection heating system.

Turning to FIGS. 1-2, the convection heating system 10 includes a plurality of fans to develop a flow of heated air within the interior cavity 14 of the oven 12. The fans can be of various types, such as axial, radial, and/or centrifugal fans. As shown, the plurality of fans 20, 22 can include a first fan 20 and a second fan 22, though various other numbers of fans can also be used. The fans 20, 22 can be similar, or even different. Additionally, the fans 20, 22 can be arranged variously about the interior cavity 14. For example, as shown, the fans 20, 22 can be arranged horizontally adjacent to each other. In addition or alternatively, the fans 20, 22 can be arranged vertically adjacent, angularly adjacent, or even spaced an extended distance from each other. Each of the fans 20, 22 can be powered individually, such as by an electric motor 21 (see FIG. 5) or the like. In addition or alternatively, a plurality of the fans can be powered by a single motor via a gear train, pulley system, or the like (not shown).

The fans 20, 22 can rotate in the same direction to provide a plurality of air flows within the interior cavity 14. For example the first fan 20 can provide a first air flow 24, while the second fan 22 can provide a second air flow 26. Where the fans 20, 22 rotate in the same direction, the first and second air flows 24, 26 can similarly rotate in the same direction to provide a flow of heated air throughout the interior cavity 14. Alternatively, at least two of the fans 20, 22 can also be configured to counter-rotate, and/or can even be configured to alter the rotational direction.

Figure 4:
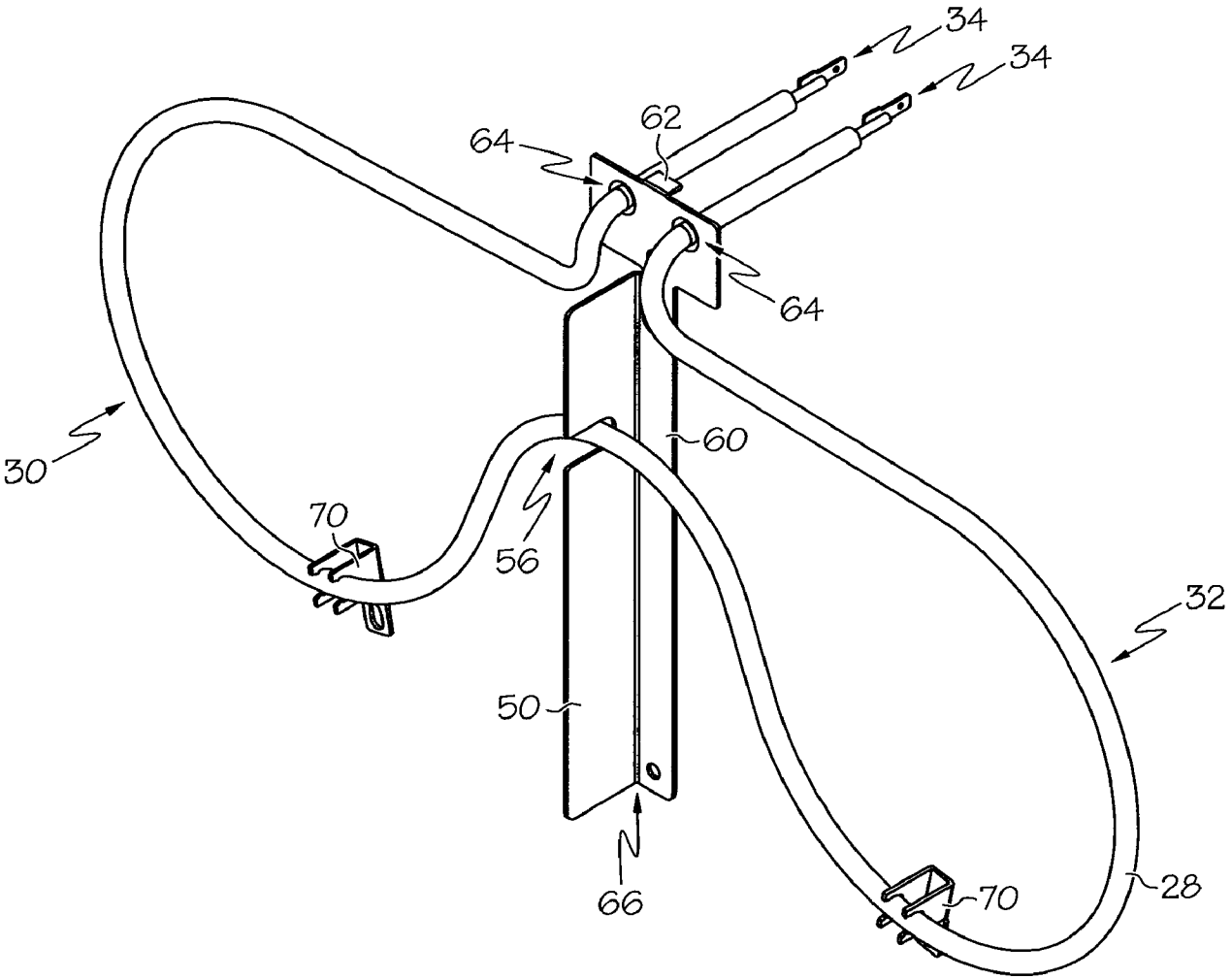
FIG. 4 shows a perspective view of an example heating element and an example baffle in accordance with another aspect of the present invention.

Each fan 20, 22 can intake air from the interior oven cavity 14, can circulate the air over a heating element 28 that heats the air, and can exhaust the heated air back into the interior oven cavity 14. A single heating element 28 can be used, though a plurality of heating elements may also be used. As shown in FIGS. 2 and 4, the heating element 28 can be a single, conventional electrical resistance element having a portion that at least partially surrounds each of the first and second fans 20, 22. For example, a first portion 30 can at least partially surround the first fan 20, while a second portion 32 can at least partially surround the second fan 22. The heating element 28 can also include one or more ends 34 that are operatively coupled to a power source. The single heating element 28 can have a generally uniform temperature, and as a result, the heated air provided by each of the fans 20, 22 can be of a generally uniform temperature. In addition or alternatively, the heating element 28 can also include a gas-fired source, an infrared energy source, etc. Moreover, the present invention is not limited to heating elements that are located directly in the exhaust path of the fans 20, 22. Instead, the heating elements can be located variously about the interior oven cavity 14, such as on other walls or the like, and/or can even include a broiler heating unit or the like.

Figure 5:
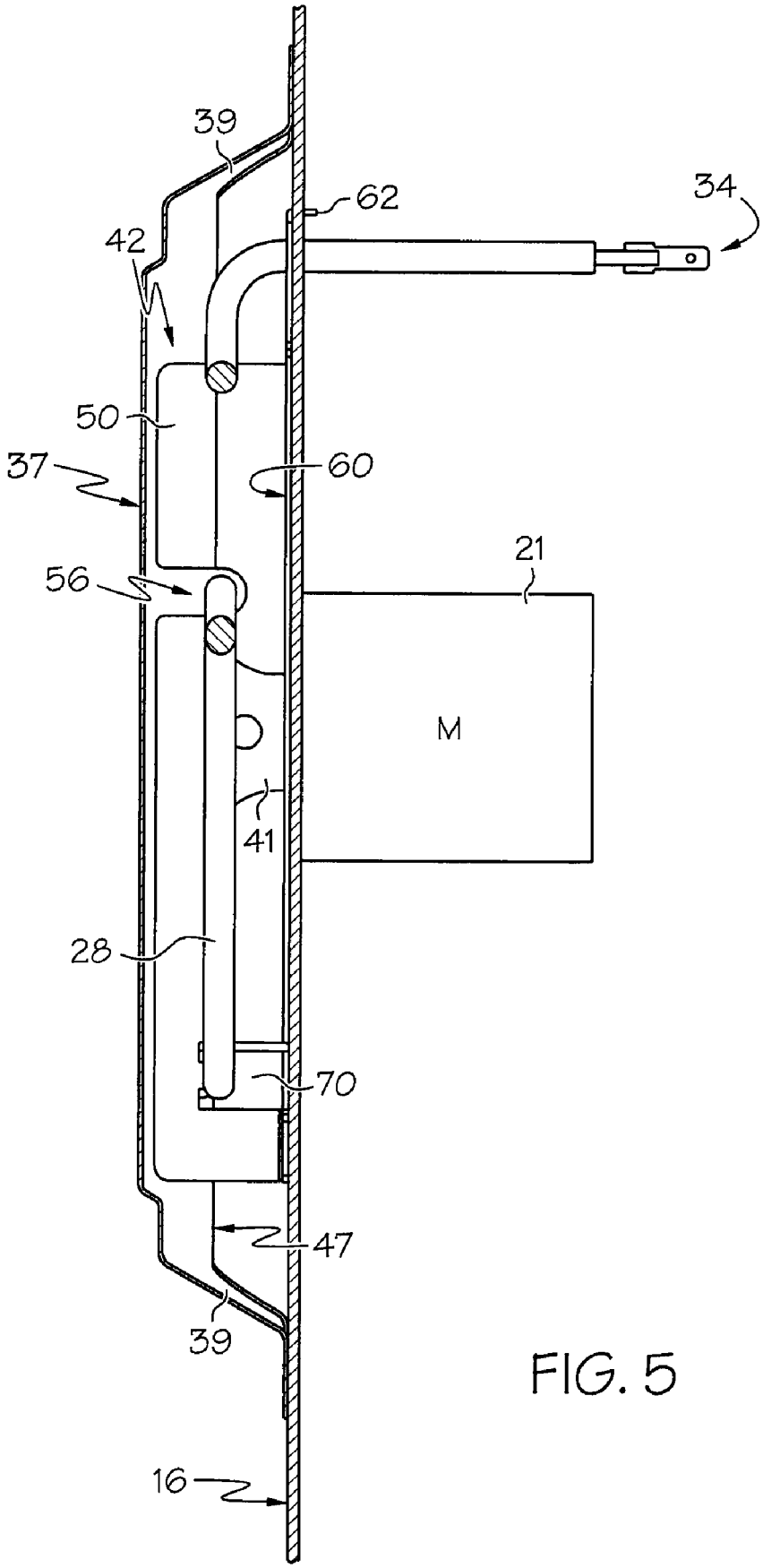
FIG. 5 shows a sectional view along line 5-5 of FIG. 1.

A shroud 36 is generally arranged in a covering relationship over the convection heating system 10. For example, the fans 20, 22 and the convection heating element 28 can be coupled to the rear wall 16 and can extend a distance into the interior oven cavity 14. Thus, the shroud 36 generally includes a face surface 37 offset a distance from the rear wall 16 to provide an interior shroud volume 42 defined between the face surface 37 and the rear wall 16 for containing the various elements of the convection heating system 10. As a result, the shroud 36 can provide protection for the various elements of the convection heating system 10. The shroud 36 further includes at least one leg 39 for coupling the shroud 36 to the rear wall 16. The at least one leg 39 can also offset the face surface 37 a desired distance from the rear wall 16, such as to provide the interior shroud volume 42 with a sufficient size to generally contain the convection heating system 10. For example, as shown in FIGS. 1 and 5, the shroud 36 can include a pair of legs 39 arranged at the top and bottom thereof. In addition or alternatively, the shroud can also include a pair of legs 41 arranged towards opposite sides thereof. Any or all of the legs 39, 41 can be coupled to the rear wall 16 in various manners, such as, for example, mechanical fasteners, snaps, clips, adhesives, welding, etc. In another example, a portion of the legs 39, 41 can interlock with a portion of the rear wall 16. Still, the shroud 36 can include various numbers of legs having various geometries. Moreover, the shroud 36 can also include structure to facilitate establishing, maintaining, and/or directing the various airflows 24, 26 within the interior oven cavity 14.

The shroud 36 includes at least one intake aperture for supplying air from the interior oven cavity 14 one or more of the fans 20, 22. For example, as shown, the shroud 36 can include a first intake aperture 38 adjacent the first fan 20, and a second intake aperture 40 adjacent the second fan 22. Thus, each fan 20, 22 can receive an independent supply of air. Any or all of the intake apertures can extend through the face surface 37 of the shroud 36, or can also be at various other locations, such as in the space between the shroud 36 and the rear wall 16. Each intake aperture 38, 40 can also include various geometries. For example, as shown, each intake aperture 38, 40 can have a generally circular geometry similar to the geometry of the fans 20, 22. The intake apertures 38, 40 can also include other geometries, such as curved geometries, random geometries, or polygonal geometries, such as square, rectangular, elliptical, triangular, etc.

Figure 6:
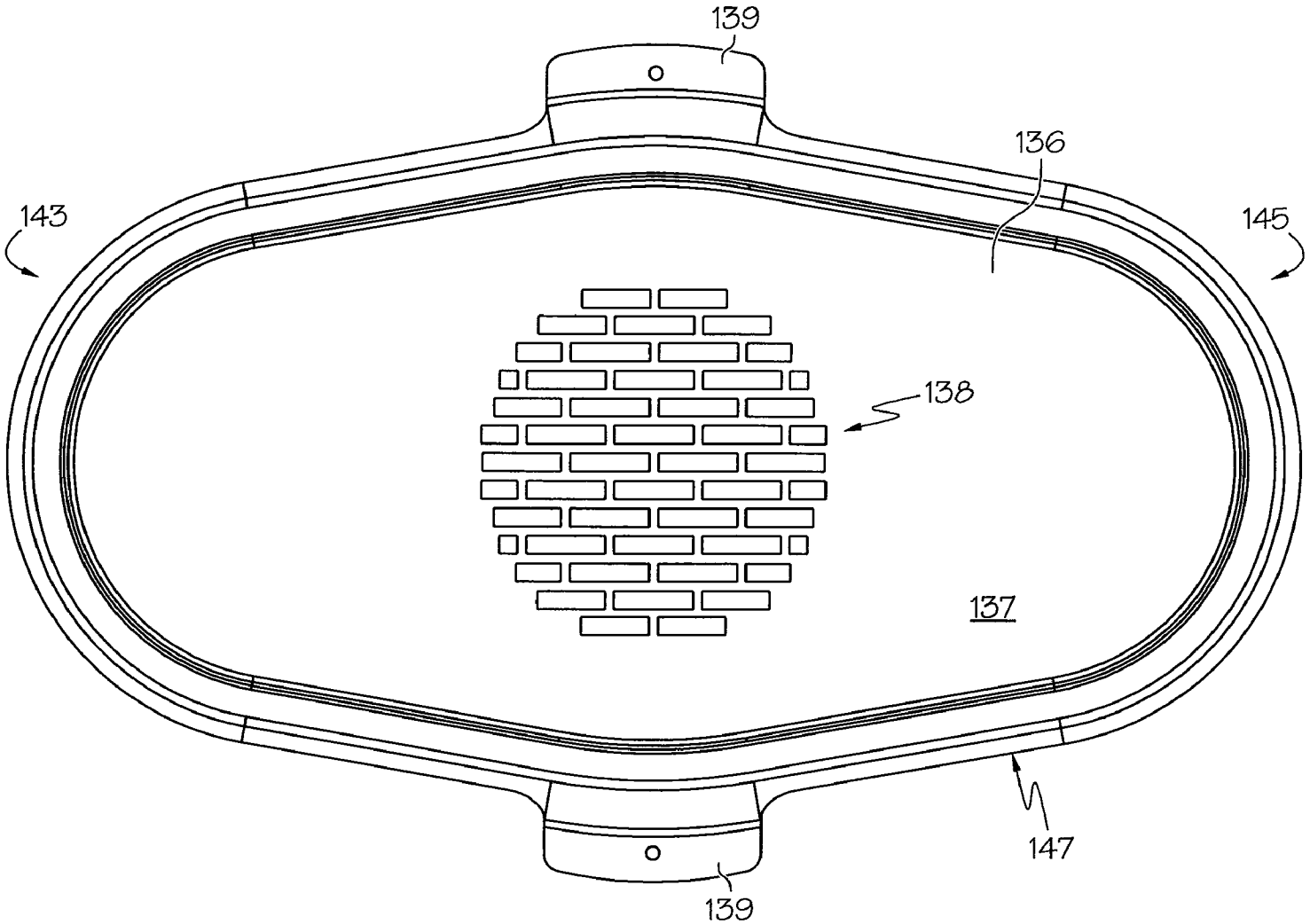
FIG. 6 shows a front view of another example shroud in accordance with another aspect of the present invention.

In addition or alternatively, the intake apertures 38, 40 can also include a plurality of adjacent openings, including various geometries that are arranged in a generally grid-like array that can act as a screen or filter to inhibit, such as prevent, relatively large objects from impacting the fans 20, 22 and/or the heating element 28. Moreover, the intake apertures 38, 40 can have an intake area that is less than, greater than, or generally equal to a frontal area of the fans 20, 22, and can even include a variable intake area. Alternatively, the shroud can also include a reduced number of intake apertures for supplying air to a portion of the fans. For example, as shown in FIG. 6, the shroud 136 can include single intake aperture 138 for supplying air to all of the fans 20, 22.

The shroud 36 also includes at least one exhaust aperture for discharging the air from the plurality of fans 20, 22 back into the interior oven cavity 14. For example, as shown, the shroud 36 can include a first exhaust aperture 43 adjacent the first fan 20, and a second exhaust aperture 45 adjacent the second fan 22. The exhaust apertures 43, 45 can be located on the sides of the shroud 36 generally in the spacing gap provided between the face surface 37 and the rear wall 16. For example, the shroud 36 can include an outer peripheral edge 47, and each of the exhaust apertures 43, 45 can be located adjacent one of the plurality of fans 20, 22 and defined between the outer peripheral edge 47 and the rear wall 16 of the interior oven cavity 14. Still, the exhaust apertures 43, 45 can also be disposed at various other locations. In addition or alternatively, as shown in FIG. 1, each exhaust aperture 43, 45 can be separated into a plurality of exhaust apertures by one or more of the legs 39, 41. Alternatively, as shown in FIG. 5, each exhaust aperture 143, 145 can also be a unitary aperture. In addition or alternatively, any or all of the exhaust apertures 43, 45 can include structure (not shown) configured to alter the exhaust air flow 24, 26, such as to alter the velocity, pressure, direction, spin, etc.

As described herein, the fans 20, 22 can intake air from the oven cavity 14 through the intake apertures 38, 40, and can subsequently exhaust said air back into the oven cavity 14 through the exhaust apertures 43, 45. However, unmanaged air flow within the interior shroud volume 42 can create an inefficient and/or uneven air flow condition, leading to undesirable cooking or drying of foods within the oven 12.

Accordingly, a baffle 50 can be provided within the shroud 36 and generally between adjacent ones of the plurality of fans 20, 22. The baffle 50 can inhibit, such as prevent, mixture of the air flows 24, 26 of each of the fans 20, 22 within the shroud 36. For example, without the baffle 50, air flow provided by one fan can be reduced and/or redirected by air flow provided by an adjacent fan. However, the baffle 50 can inhibit mixture of the air flows 24, 26 such that each fan 20, 22 can provide an independent output generally unaffected by the other fans. However, the fans 20, 22 may still provide some influence upon the operation of the other fans. Moreover, it is be appreciated that the baffle 50 can directly control the interaction of the air flows 24, 26 within the interior shroud volume 42, though can also indirectly control the interaction of the air flows 24, 26 outside of the interior shroud volume 42.

The baffle 50 can be located generally within the interior shroud volume 42 and between adjacent fans 20, 22. For example, as shown in FIG. 2, the baffle 50 can be located approximately centrally between two horizontally adjacent fans 20, 22. Still, the baffle 50 can also be biased towards either of the fans 20, 22, and/or can be located at various other locations. In addition or alternatively, the baffle 50 can be oriented generally transverse to the rear wall 16 of the oven cavity 14, though can also extend at various other angles between the shroud 36 and the rear wall 16.

Figure 3:
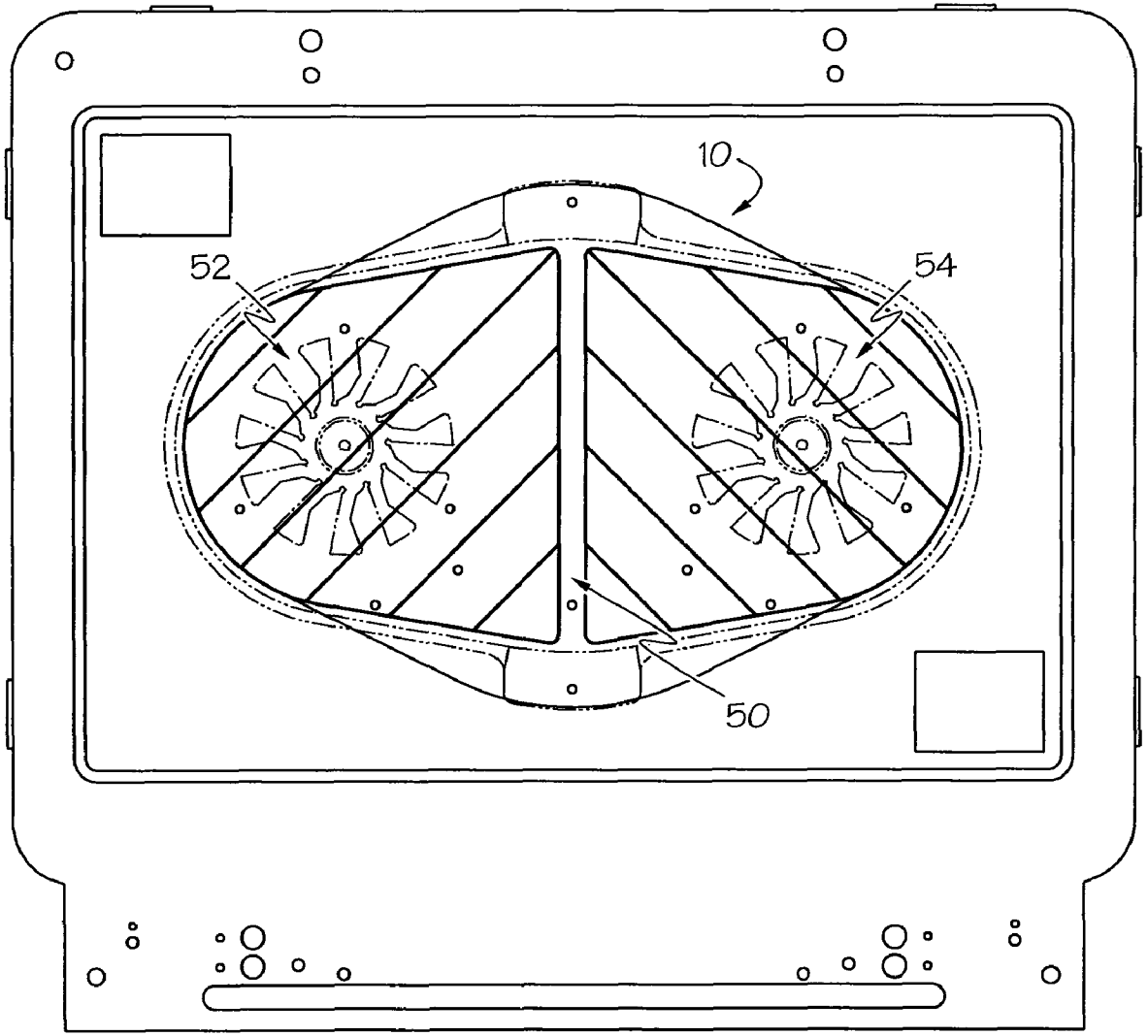
FIG. 3 is similar to FIG. 1, but shows the example shroud in phantom and example sub-volumes within the shroud in accordance with another aspect of the present invention.

The baffle 50 can also extend generally between the rear wall 16 and the shroud 36. For example, as shown in FIG. 5, the baffle 50 can be coupled to a portion of the rear wall 16 and can extend towards the shroud 36. In another example, not shown, the baffle 50 can be coupled to a portion of the shroud 36 and extend towards the rear wall 16. As shown in FIG. 3, the baffle 50 can extend generally between the shroud 36 and the rear wall 16 so as divide the interior shroud volume 42 into at least a first sub-volume 52 adjacent the first fan 20, and a second sub-volume 54 adjacent the second fan 22. Thus, the baffle 50 can inhibit, such as prevent, fluid communication between the first and second sub-volumes 52, 54. Further, the first and second sub-volumes 52, 54 can be of generally similar size and/or geometry if the baffle 50 is located generally centrally therebetween. However, it is to be appreciated that the sub-volumes 52, 54 can have various geometries, and/or various other sub-volumes can also be created by the shroud 36, baffle 50, or various other elements.

Moreover, the baffle 50 can be in contact with either or both of the shroud 36 and the rear wall 16, or can be spaced a distance therefrom. In addition or alternatively, a spacer or the like (not shown) can be provided between the shroud and the rear wall 16. However, the baffle 50 can be also configured to accommodate various elements within the shroud 36, such as at least a portion of the convection heating element 28. For example, the baffle 50 can include an aperture 56 configured to permit the single heating element 28 to extend therethrough. Still, it can be beneficial to arrange the baffle 50 and aperture 56 so as to inhibit, such as prevent, interaction between the first and second exhaust air flows 24, 26.

In one example, each of the first and second fans 20, 22 can provide a positive pressure airflow 24, 26, respectively, directed generally outwards from the fan blades. Without the baffle 50, at least a portion of the air flows 24, 26 can interact with each other to alter the pressure zone therebetween, such as to create a relatively lower pressure zone. Thus, the baffle 50 can reduce the interaction between the positive pressure airflows 24, 26 to thereby inhibit, such as prevent, the formation of a relatively lower pressure zone between the first and second fans 20, 22. In another example, each of the first and second fans 20, 22 can provide airflows 24, 26 having a first flow rate and a second flow rate, respectively. Without the baffle 50, at least a portion of the air flows 24, 26 can interact with each other to alter, such as reduce, the first and/or second flow rates of exhaust air. Thus, the baffle 50 can control the interaction between the positive pressure airflows 24, 26 to thereby to reduce, such as prevent, a difference between the first and second flow rates. For example, the baffle 50 can inhibit the mixture between the first and second air flows 24, 26 such that the difference between the first and second air flow rate is less than or equal to ten percent, or even five percent, though various other vales are also contemplated. It is to be appreciated that the air flow rates can be measured in various manners, such as volumetric flow rates, mass air flow rates, etc. under similar conditions, and/or accounting for appropriate adjusting variables. Accordingly, the exhaust air can be provided by the fans 20, 22 in a relatively more efficient and even manner.

The oven 12 can also include various other elements. For example, a bracket 60 can be coupled to the rear wall 16. The bracket 60 can be coupled to the rear wall 16 in various manners, including mechanical fasteners, snaps, clips, adhesives, welding, etc. In another example, a portion 62 of the bracket 60 can interlock with a portion of the rear wall 16. The bracket 60 can also be configured to secure the heating element 28 to the rear wall 16. In addition or alternatively, the bracket 60 can also include an aperture 64 and/or a coupler (not shown) for receiving and coupling to a portion of the heating element 28. Thus, in one example, the bracket 60 and the heating element 28 can form a sub-assembly that is secured to the rear wall 16 of the oven 12, though each component can also be separate. In addition or alternatively, the baffle 50 can be coupled to a portion of the bracket 60 for maintaining the location of the baffle 50 during operation of the convection heating system 10. In one example, the baffle 50 can be a separate component that is coupled to the bracket 60 by way of mechanical fasteners, snaps, clips, adhesives, welding, interlocking engagement, etc. In another example, the baffle 50 can be formed with a portion of the bracket 60, so as to provide a generally L-shaped geometry 66, T-shaped geometry, or the like. In yet another example, the baffle 50 can be adjustably coupled to the bracket 60 to permit adjustment of the baffle 50 relatively to the bracket 60 and/or the shroud 36.

In another example, the oven 12 can include one or more spacers 70 for securing and/or supporting a portion of the heating element 28. The spacers 70 can locate the heating element 28 adjacent to the fans 20, 22 to facilitate heating air passing thereby. The spacers 70 can also inhibit, such as prevent, vibration of the heating element during operation of the fans 20, 22.

It is to be appreciated that although the air movement systems discussed herein feature a heating element for heating the air, the invention can also be utilized in an air movement system that does not include a heating element. For example, some ovens include an air movement system for providing better air circulation within the oven cavity, without also providing an additional convection heating system. In such an example, a baffle arranged generally between adjacent fans can still provide a relatively more efficient and/or even air flow. In a similar example, an oven that includes a convection heating system can include a feature for selectively disabling the heating element of a convection heating system for providing only increased air circulation.

Moreover, it is to be appreciated that the present invention can also be used in various environments having various temperatures. For example, the present invention can be used in an ambient or even a refrigerated environment. In a refrigerated environment, an evaporator or the like can be disposed in the exhaust flow path to provide a cooled air flow. In addition or alternatively, the present invention can also be used in various environments having various humidity levels, so as to use the air flow for increasing, decreasing, or maintaining the humidity level. The present invention can also be used in microwave ovens that the like.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An oven, including:

a door;

a main body portion including an interior cavity having a rear wall opposite the door;

a convection heating system for developing a flow of heated air within the interior cavity including a plurality of fans each rotating in the same direction to provide a plurality of airflows, and a single convection heating element for heating the plurality of airflows;

a shroud arranged in covering relationship over the convection heating system including at least one intake aperture for supplying air from the interior cavity to the plurality of fans and a plurality of exhaust apertures for discharging air from the plurality of fans back into the interior cavity, the shroud having a face surface and sides extending from the periphery of the face surface; and a baffle located within the shroud and generally between adjacent ones of the plurality of fans, the baffle inhibiting mixture of the airflows of each of the fans within the shroud, wherein the at least one intake aperture extends through the face surface of the shroud, and wherein the plurality of exhaust apertures are located on the sides of the shroud.

2. The oven of claim 1, further including a bracket coupled to an inner wall of the interior oven cavity for securing the single heating element to the inner wall, wherein the baffle is coupled to a portion of the bracket for maintaining the location of the baffle during operation of the convection heating system.

3. The oven of claim 1, wherein the plurality of fans includes a first fan and a second fan, and wherein the baffle extends generally between an inner wall of the interior oven cavity and the shroud to divide the shroud into at least a first sub-volume adjacent the first fan and a second sub-volume adjacent the second fan, the baffle inhibiting fluid communication between the first and second sub-volumes.

4. The oven of claim 1, wherein the plurality of fans includes a first fan and a second fan that each provide a positive pressure airflow, and wherein the baffle is located adjacent the shroud and generally between the first and second fans to reduce interaction of the first and second positive pressure airflows to thereby inhibit the formation of a relatively lower pressure zone between the first and second fans.

5. The oven of claim 1, wherein the baffle lies in a plane that is oriented perpendicularly with a plane of an inner wall of the interior oven cavity and extends generally between the inner wall and the shroud.

6. The oven of claim 1, wherein the plurality of fans includes a first fan providing an airflow having a first flow rate and a second fan providing a second airflow having a second flow rate, and wherein the baffle inhibits mixture of the airflows such that a difference between the first and second flow rates is less than or equal to 5% (five percent).

7. The oven of claim 1, wherein the plurality of fans are arranged horizontally adjacent to each other.

8. The oven of claim 7, wherein the baffle is located approximately centrally between two horizontally adjacent fans.

9. The oven of claim 1, wherein the baffle includes an aperture adapted to permit the single heating element to extend therethrough.

10. The oven of claim 1, wherein a portion of the heating element at least partially surrounds each of the fans.

11. The oven of claim 1, wherein the plurality of fans and the single convection heating element are coupled to an inner wall of the interior cavity and extend a distance into the interior oven cavity.

12. The oven of claim 1, wherein the shroud includes at least one leg coupled to an inner wall of the interior oven cavity to offset the face surface a distance therefrom.

13. An oven, including:

a door;

a main body portion including an interior oven cavity having a rear wall opposite the door;

a convection heating system for developing a flow of heated air within the interior oven cavity including a first fan providing a first airflow, a second fan providing a second airflow and rotating in the same direction as the first fan, and a convection heating element for heating both of the first and second airflows;

a shroud arranged in covering relationship over the convection heating system, the shroud further including at least one intake aperture for supplying air from the interior oven cavity to the first and second fans and a plurality of exhaust apertures for discharging the first and second airflows back into the interior oven cavity; and a baffle located within the shroud and generally between the first and second fans, the baffle inhibiting mixture of the first and second airflows within shroud, wherein the shroud includes an outer peripheral edge, each of the plurality of exhaust apertures being located on the outer peripheral edge.

14. The oven of claim 13, wherein the baffle extends generally between an inner wall of the interior oven cavity and the shroud to divide the shroud into at least a first sub-volume adjacent the first fan and a second sub-volume adjacent the second fan, the baffle inhibiting fluid communication between the first and second sub-volumes.

15. The oven of claim 13, wherein the first and second fans each provide a positive pressure airflow, and wherein the baffle is located adjacent the shroud and generally between the first and second fans to reduce interaction of the first and second positive pressure airflows to thereby inhibit the formation of a relatively lower pressure zone between the first and second fans.

16. The oven of claim 13, wherein the first fan provides an airflow having a first flow rate and the second fan provides a second airflow having a second flow rate, and wherein the baffle inhibits the mixture of the airflows such that the difference between the first and second flow rates is less than or equal to 5% (five percent).

17. The oven of claim 13, wherein the first fan is arranged horizontally adjacent to the second fan, the baffle being located approximately centrally between the first and second fans.

18. The oven of claim 13, wherein the baffle includes an aperture adapted to permit the convection heating element to extend therethrough.

19. The oven of claim 13, wherein each of the fans and the convection heating element are coupled to an inner wall of the interior oven cavity and extend a distance into the interior oven cavity.

20. The oven of claim 13, wherein the shroud includes a face surface and pair of legs coupled to an inner wall of the interior oven cavity to offset the face surface a distance therefrom.

21. An oven, including:

a door;

a main body portion including an interior oven cavity having a rear wall opposite the door;

a convection heating system for developing a flow of heated air within the interior oven cavity including a first rotatable fan providing a first airflow, a second rotatable fan providing a second airflow and rotating in the same direction as the first rotatable fan, and a single convection heating element for heating both of the first and second airflows, each of the fans and the convection heating element being coupled to an inner wall of the interior oven cavity and extending a distance into the interior oven cavity;

a shroud arranged in covering relationship over the convection heating system including a face surface, an outer peripheral edge, and a pair of legs coupled to the inner wall to offset the face surface a distance from the inner wall to define an interior shroud volume therebetween, the interior shroud volume having a sufficient size to contain the convection heating system, the shroud further including a pair of intake apertures extending through the face surface for supplying air from the interior oven cavity to each of the first and second fans and a pair of exhaust apertures for discharging the first and second airflows back into the interior oven cavity, each exhaust aperture being located adjacent a respective one of the fans and being defined between the outer peripheral edge and the inner wall of the interior oven cavity; and a baffle located within the interior shroud volume and generally between the first and second fans, the baffle extending generally between the inner wall and the shroud to divide the interior shroud volume into at least a first sub-volume adjacent the first fan and a second sub-volume adjacent the second fan, the baffle inhibiting fluid communication between the first and second sub-volumes.

22. The oven of claim 21, further including a bracket coupled to the inner wall for securing the single heating element to the inner wall, wherein the baffle is coupled to a portion of the bracket for maintaining the location of the baffle during operation of the convection heating system.

23. The oven of claim 21, wherein the first fan is arranged horizontally adjacent to the second fan and the baffle is located approximately centrally between the first and second fans such that the first sub-volume is approximately equal in size to the second sub-volume.

24. The oven of claim 21, wherein the baffle includes an aperture having a size and geometry adapted to permit the single convection heating element to extend through the aperture, while inhibiting fluid communication between the first and second sub-volumes through the aperture.

* * * * *